US010459397B2

(12) United States Patent
Mizutani

(10) Patent No.: US 10,459,397 B2
(45) Date of Patent: Oct. 29, 2019

(54) IMAGE FORMING APPARATUS

(71) Applicant: KYOCERA Document Solutions Inc., Osaka-shi (JP)

(72) Inventor: Naoki Mizutani, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/269,760

(22) Filed: Feb. 7, 2019

(65) Prior Publication Data

US 2019/0250551 A1 Aug. 15, 2019

(30) Foreign Application Priority Data

Feb. 15, 2018 (JP) ..... 2018-025047

(51) Int. Cl.
*G03G 15/04* (2006.01)
*G03G 21/16* (2006.01)
*G03G 15/08* (2006.01)

(52) U.S. Cl.
CPC ..... *G03G 21/1633* (2013.01); *G03G 15/0856* (2013.01); *G03G 15/0865* (2013.01); *G03G 15/0867* (2013.01); *G03G 2215/0634* (2013.01)

(58) Field of Classification Search
CPC ..... G03G 15/0856; G03G 15/0865; G03G 15/0867; G03G 15/0868; G03G 21/1633; G03G 21/1623; G03G 2215/0634
See application file for complete search history.

(56) References Cited

U.S. PATENT DOCUMENTS

2010/0247137 A1* 9/2010 Akaike ..... G03G 21/12 399/110
2010/0272452 A1 10/2010 Tsukijima
2010/0329730 A1* 12/2010 Fujita ..... G03G 21/185 399/110
2011/0058825 A1 3/2011 Tsukijima
2014/0321884 A1* 10/2014 Kitagawa ..... G03G 15/0865 399/258

FOREIGN PATENT DOCUMENTS

JP 2010-256557 11/2010
JP 2011-059296 3/2011

* cited by examiner

*Primary Examiner* — Hoang X Ngo
(74) *Attorney, Agent, or Firm* — Gerald E. Hespos; Michael J. Porco; Matthew T. Hespos

(57) ABSTRACT

An image forming apparatus includes: an apparatus body; a body cover: photoreceptor drums; developing devices; toner containers; container covers; lock release mechanisms; pressing units; latching parts; and interlocking mechanisms. Each of the plurality of pressing units presses the toner container toward the container cover within the apparatus body. Each of the plurality of latching parts latches the toner container against pressing force of the pressing unit at a replenishment position where the toner is replenishable to the developing device within the apparatus body. Each of the plurality of interlocking mechanisms moves the toner container from the replenishment position to a side of the container cover by the pressing force of the pressing unit by releasing the latch of the latching part to the toner container in conjunction with lock release of the container cover by the lock release mechanism.

6 Claims, 17 Drawing Sheets

IMAGE FORMING APPARATUS

This application relates to and claims priority from Japanese Patent Application No. 2018-025047 filed in the Japan Patent Office on Feb. 15, 2018, the entire disclosure of which is incorporated herein by reference.

BACKGROUND

The present disclosure relates to an image forming apparatus for forming an image on a sheet.

Conventionally, an image forming apparatus that employs an electrophotographic method such as a printer and a copying machine includes a photoreceptor drum that supports an electrostatic latent image, a developing device that supplies the photoreceptor drum with toner to visualize the electrostatic latent image in a toner image, and a transfer device that transfers the toner image from the photoreceptor drum to a sheet.

An image forming apparatus including a plurality of developing devices corresponding to color toners of respective colors in which a plurality of toner containers for supplying each developing device with replenishing toner is disposed is known. This technique includes a plurality of container covers that can be opened and closed in a front part of an apparatus body. When the container covers are opened, the toner containers will be exposed to outside, enabling replacement of the toner containers.

When a predetermined toner container becomes empty, this technique displays, on a display unit, information indicating that the toner container is empty. Then, when a user operates the display unit, the container cover of the toner container is opened. As a result, the user can replace the toner container.

SUMMARY

An image forming apparatus according to one aspect of the present disclosure includes: an apparatus body; a body cover: a plurality of photoreceptor drums; a plurality of developing devices; a plurality of toner containers; a plurality of container covers; a plurality of lock release mechanisms; a plurality of pressing units; a plurality of latching parts; and a plurality of interlocking mechanisms. The body cover allows opening and closing with respect to the apparatus body. Each of the plurality of photoreceptor drums is rotated about a predetermined axis and has a peripheral surface that allows formation of an electrostatic latent image and supports a toner image corresponding to the electrostatic latent image. Each of the plurality of developing devices supplies the photoreceptor drum with toner to visualize the electrostatic latent image in the toner image. Each of the plurality of toner containers accommodates the toner to be replenished to the developing device. The plurality of container covers is a plurality of container covers to be exposed to outside of the apparatus body by the body cover being opened. Each of the container covers is switchable between an open state in which attachment and detachment of the toner container with respect to the apparatus body are allowed, and a closed state in which detachment of the toner container from the apparatus body is prevented. Each of the plurality of lock release mechanisms includes a locking part that locks the container cover in the closed state and is configured to release the lock of the container cover by the locking part and to make the container cover in the open state. Each of the plurality of pressing units presses the toner container toward the container cover within the apparatus body. Each of the plurality of latching parts latches the toner container against pressing force of the pressing unit at a replenishment position where the toner is replenishable to the developing device within the apparatus body. Each of the plurality of interlocking mechanisms moves the toner container from the replenishment position to a side of the container cover by the pressing force of the pressing unit by releasing the latch of the latching part to the toner container in conjunction with lock release of the container cover by the lock release mechanism.

DETAILED DESCRIPTION

An image forming apparatus 10 according to one embodiment of the present disclosure will be described in detail below with reference to the drawings. As one example of the image forming apparatus, the present embodiment illustrates a tandem color printer. The image forming apparatus may be, for example, a copying machine, a facsimile, a multifunction machine of these machines, or the like. The image forming apparatus may be a printer, a copying machine, or the like that forms a single-color (monochrome) image.

Figure 1:
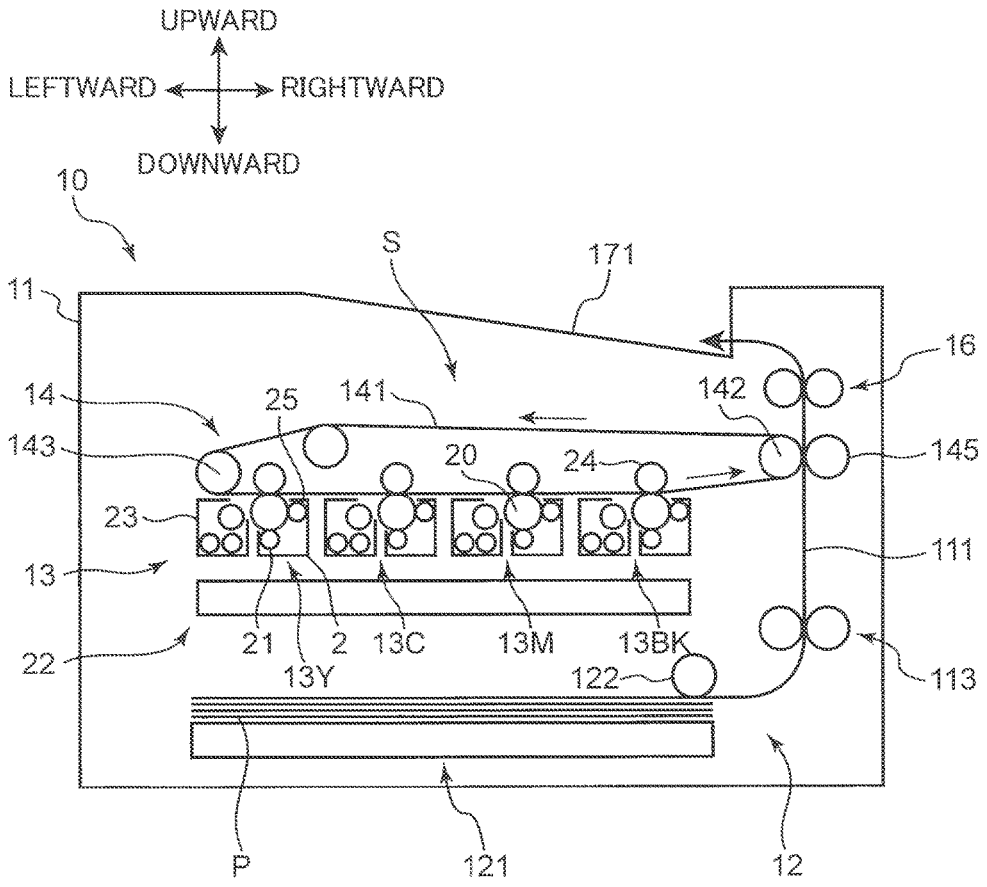
FIG. 1 is a cross-sectional view showing an internal structure of an image forming apparatus according to one embodiment of the present disclosure.

FIG. 1 is a cross-sectional view showing an internal structure of the image forming apparatus 10. The image forming apparatus 10 includes an apparatus body 11 having a box-shaped housing structure. In this apparatus body 11, a sheet feeding unit 12 that feeds a sheet P, an image forming unit 13 that forms a toner image to be transferred onto the sheet P fed from the sheet feeding unit 12, an intermediate transfer unit 14 to which the toner image is primarily transferred, a secondary transfer roller 145, and a fixation unit 16 that performs a process of fixing, onto the sheet P, an unfixed toner image formed on the sheet P are installed. Furthermore, on an upper portion of the apparatus body 11, there is provided a sheet ejecting portion 171 into which the sheet P that has undergone the fixation process in the fixation unit 16 is ejected.

In the apparatus body 11, a vertically extending sheet conveyance path 111 is further formed at a position on a right side of the image forming unit 13. A pair of conveyance rollers for conveying the sheet P is provided at an appropriate position on the sheet conveyance path 111. In addition, a pair of registration rollers 113 for correcting skew of the sheet P and feeding the sheet P at a predetermined timing to a secondary transfer nip to be described later is also provided on an upstream side of the nip on the sheet conveyance path 111. The sheet conveyance path 111 is a conveyance path that conveys the sheet P from the sheet feeding unit 12 to the sheet ejecting portion 171 via the image forming unit 13 (secondary transfer nip) and the fixation unit 16.

The sheet feeding unit 12 includes a sheet feeding tray 121 and a pickup roller 122. The sheet feeding tray 121 is detachably installed at a lower position of the apparatus body 11, and stores a sheet bundle in which a plurality of sheets P is stacked. The pickup roller 122 feeds the uppermost sheet P of the sheet bundle stored in the sheet feeding tray 121 one by one.

The image forming unit 13 forms a toner image to be transferred onto the sheet P, and includes a plurality of image forming units for forming toner images of different colors. As these image forming units, the present embodiment includes a yellow unit 13Y using a yellow (Y) toner, a cyan unit 13C using a cyan (C) toner, a magenta unit 13M using a magenta (M) toner, and a black unit 13BK using a black (Bk) toner which are respectively arranged according to toners of a plurality of colors from an upstream side to a downstream side in a rotation direction of an intermediate transfer belt 141, which will be described later (from a left side to a right side in FIG. 1). Each unit includes a photoreceptor drum 20, a charging device 21 disposed around the photoreceptor drum 20, a developing device 23, and a cleaning device 25. In addition, an exposure device 22 common to each unit is disposed below the image forming units.

The photoreceptor drum 20 is driven to rotate around a predetermined axis extending in a front-rear direction, and allows the formation of an electrostatic latent image on the peripheral surface thereof and supports the toner image. The charging device 21 uniformly charges a surface of the photoreceptor drum 20. The exposure device 22 includes various optical devices such as a light source, a polygon mirror, a reflection mirror, and a deflection mirror. The exposure device 22 forms an electrostatic latent image by irradiating the peripheral surface of the uniformly charged photoreceptor drum 20 with light modulated based on image data. The cleaning device 25 cleans the peripheral surface of the photoreceptor drum 20 after the toner image transfer. In the present embodiment, the photoreceptor drum 20, the charging device 21, and the cleaning device 25 are integrated with each other to constitute a drum unit 2 (2Y, 2C, 2M, 2BK) (FIG. 1).

The developing device 23 supplies the peripheral surface of the photoreceptor drum 20 with toner in order to develop (visualize) the electrostatic latent image formed on the photoreceptor drum 20. The developing device 23 contains magnetic one-component toner as a developer. Note that in the present embodiment, the toner has a characteristic of being charged to positive polarity. In other embodiments, the developing device 23 may employ another developing method such as a two-component developer method including toner and carrier or a nonmagnetic one-component.

The intermediate transfer unit 14 is disposed above the image forming unit 13. The intermediate transfer unit 14 includes the intermediate transfer belt 141, a driving roller 142, a driven roller 143, and four primary transfer rollers 24. Note that in FIG. 1, only the rightmost primary transfer roller is denoted with a symbol 24.

The intermediate transfer belt 141 is an endless belt-shaped rotating body. The intermediate transfer belt 141 is wound around the driving roller 142 and the driven roller 143 such that the peripheral surface side of the intermediate transfer belt 141 is in contact with the peripheral surface of each photoreceptor drum 20. The intermediate transfer belt 141 is driven to rotate in one direction and supports, on its surface, the toner image transferred from the photoreceptor drum 20.

The driving roller 142 stretches the intermediate transfer belt 141 on a right end side of the intermediate transfer unit 14 and drives the intermediate transfer belt 141 to rotate. The driving roller 142 is made of a metal roller. The driven roller 143 stretches the intermediate transfer belt 141 on a left end side of the intermediate transfer unit 14. The driven roller 143 applies tension to the intermediate transfer belt 141.

Each of the primary transfer rollers 24 forms a primary transfer nip together with the photoreceptor drum 20 with the intermediate transfer belt 141 interposed therebetween. The primary transfer roller 24 primarily transfers the toner image on the photoreceptor drum 20 onto the intermediate transfer belt 141. The primary transfer rollers 24 are disposed so as to face the photoreceptor drums 20 of respective colors.

The secondary transfer roller 145 is disposed facing the driving roller 142 with the intermediate transfer belt 141 interposed therebetween. The secondary transfer roller 145 is pressed against the peripheral surface of the intermediate transfer belt 141 to form the secondary transfer nip. The toner image primarily transferred onto the intermediate transfer belt 141 is secondarily transferred to the sheet P fed from the sheet feeding unit 12 in the secondary transfer nip. The intermediate transfer unit 14 and the secondary transfer roller 145 of the present embodiment constitute a transfer unit of the present disclosure. The transfer unit transfers the toner image formed in the image forming unit 13 from the photoreceptor drum 20 to the sheet P.

The sheet P fed to the fixation unit 16 is heated and pressed by passing through a fixation nip. With this operation, the toner image transferred onto the sheet P in the secondary transfer nip is fixed on the sheet P.

The sheet ejecting portion 171 is formed by recessing a top portion of the apparatus body 11. The sheet P undergone the fixation process is ejected to the sheet ejecting portion 171 via the sheet conveyance path 111 extending from an upper portion of the fixation unit 16.

Figure 2:
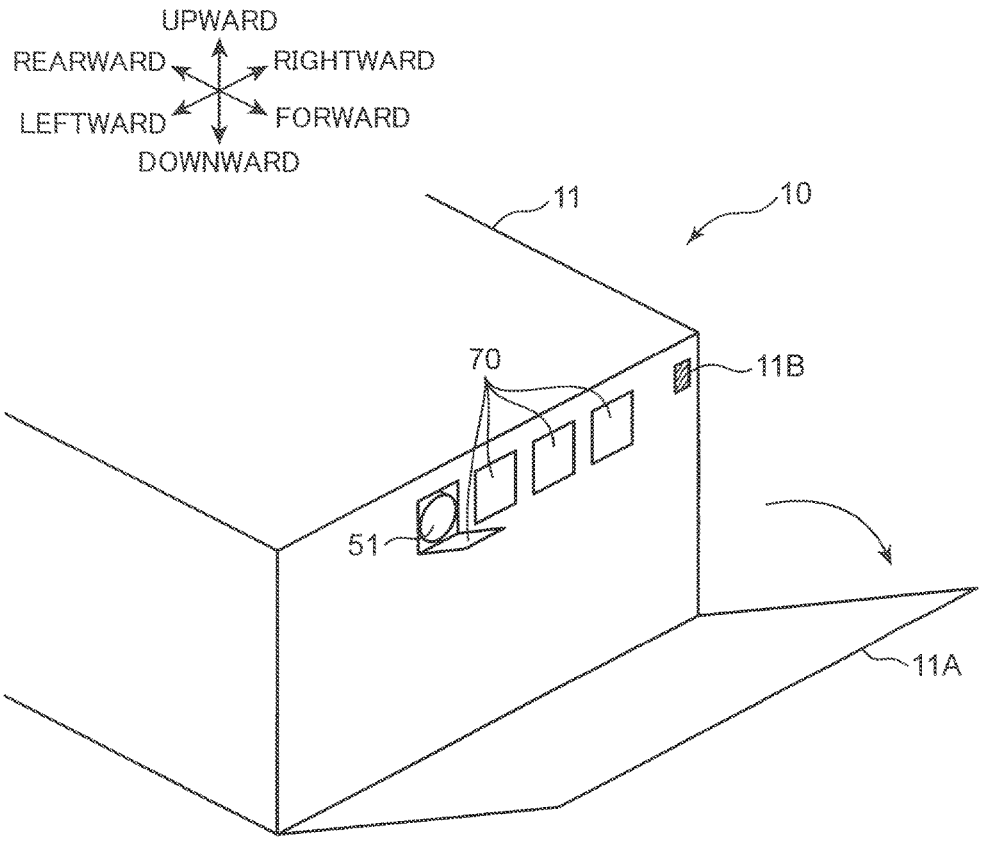
FIG. 2 is a schematic perspective view of the image forming apparatus according to one embodiment of the present disclosure with a body cover of an apparatus body opened.

FIG. 2 is a schematic perspective view of the image forming apparatus 10 according to the present embodiment with a body cover 11A of the apparatus body 11 opened. The image forming apparatus 10 further includes the body cover 11A and a cover sensor 11B. The body cover 11A defines a front part of the apparatus body 11, and can be opened and closed with respect to the apparatus body 11. In the present embodiment, a fulcrum for opening and closing the body cover 11A is disposed in a lower end of the body cover 11A, and extends in a left-right direction. The cover sensor 11B detects the opening and closing of the body cover 11A.

Figure 3:
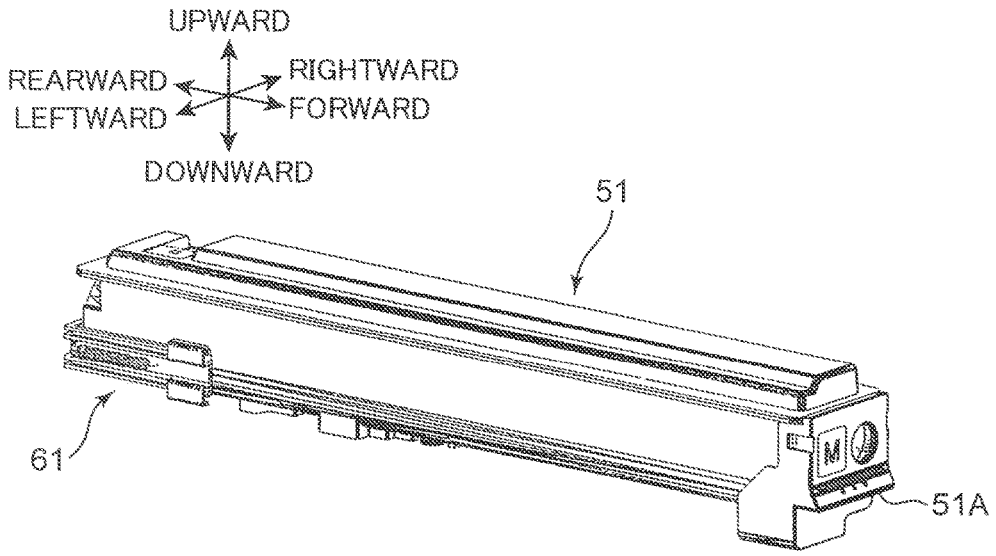
FIG. 3 is a perspective view of a toner container and a pressing unit according to one embodiment of the present disclosure.
Figure 4:
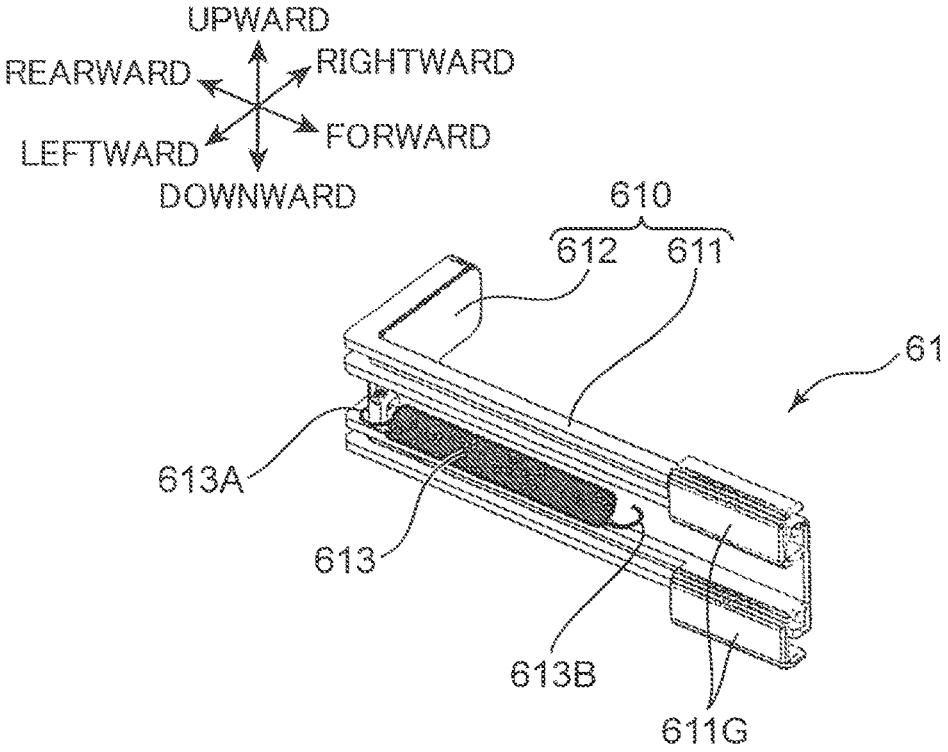
FIG. 4 is a perspective view of the pressing unit according to one embodiment of the present disclosure.
Figure 5:
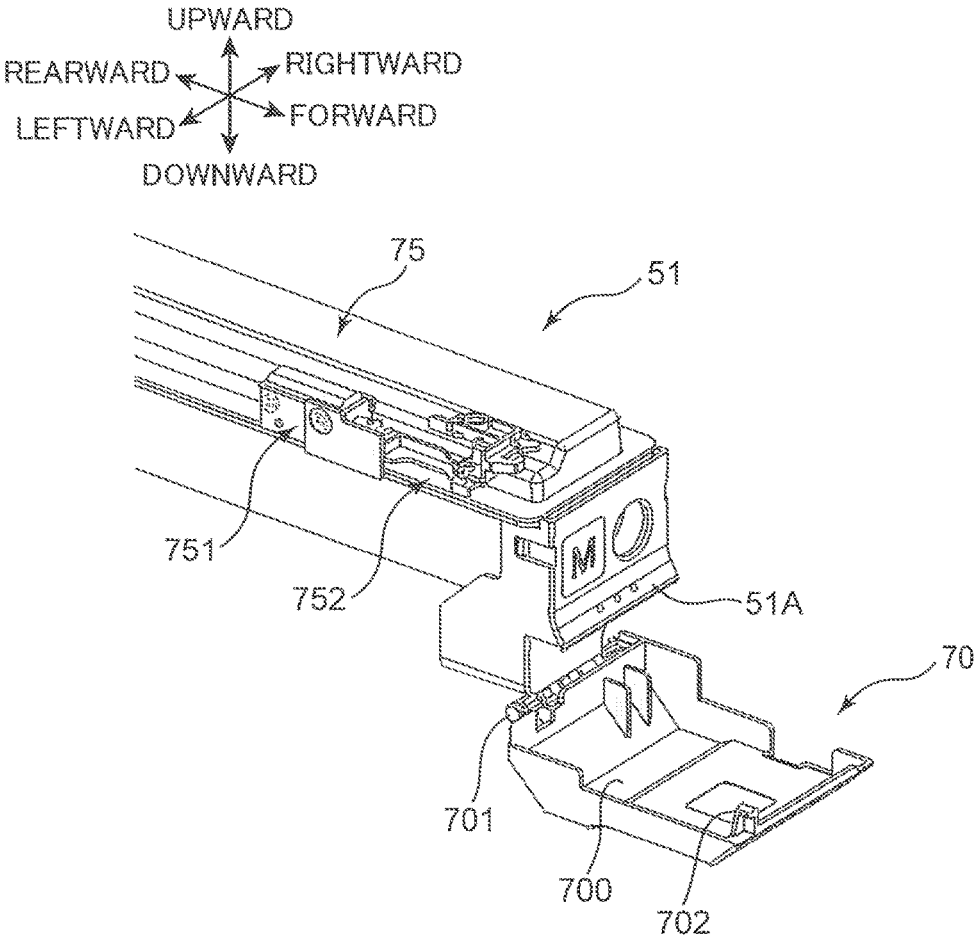
FIG. 5 is a perspective view of the toner container and a container cover according to one embodiment of the present disclosure.
Figure 6:
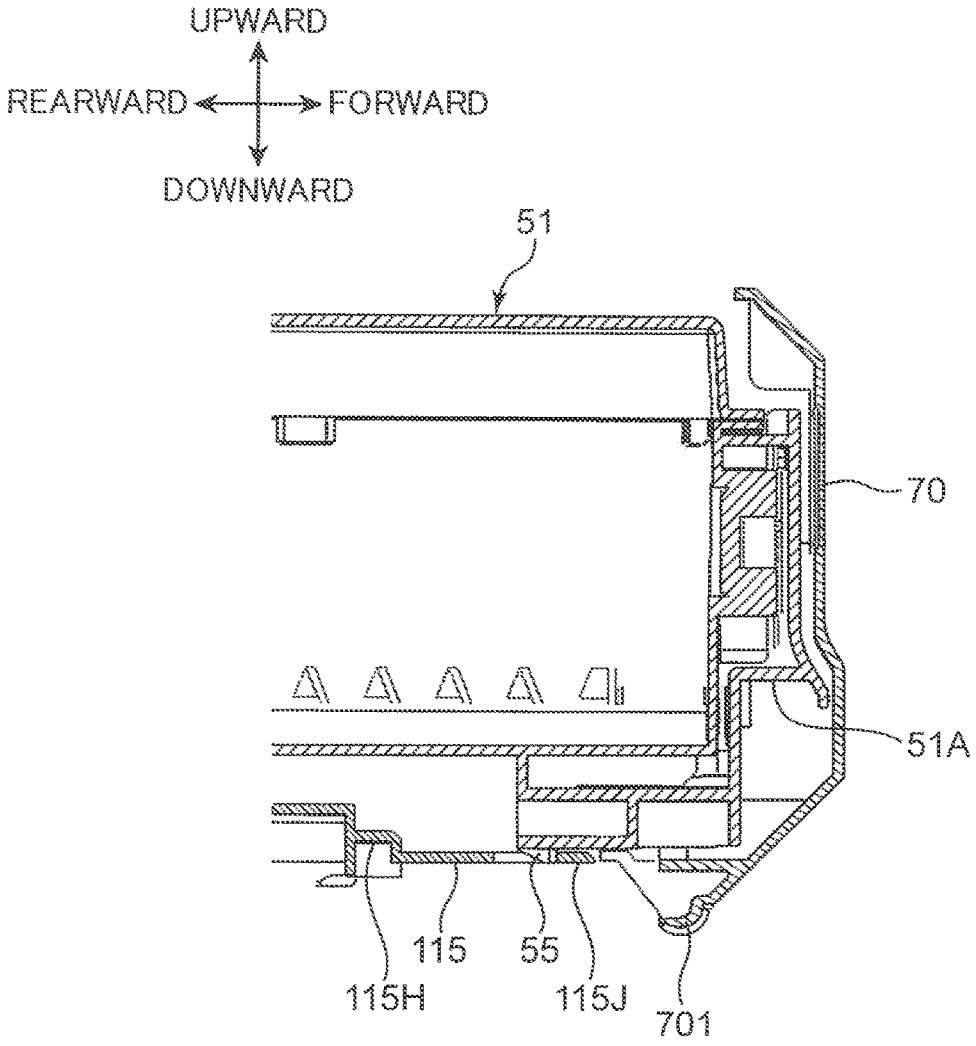
FIG. 6 is a cross-sectional view of the toner container and the container cover according to one embodiment of the present disclosure.
Figure 7:
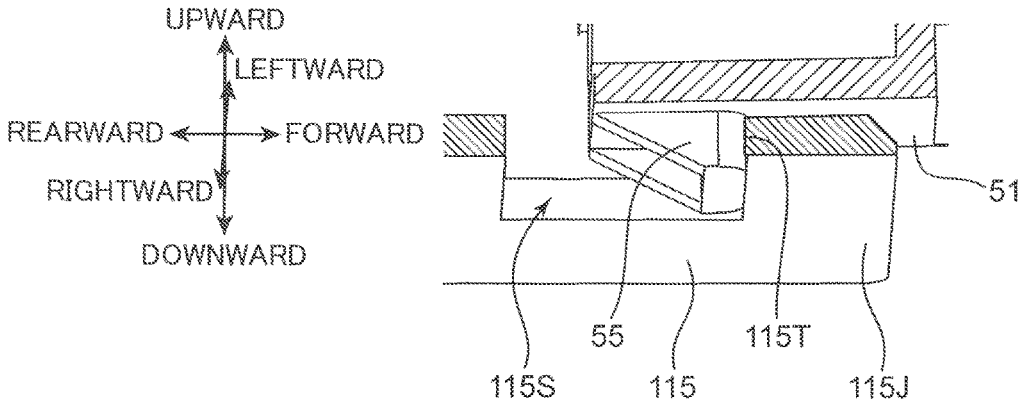
FIG. 7 is a cross-sectional perspective view obtained by enlarging a periphery of a container protrusion part of the toner container according to one embodiment of the present disclosure.
Figure 8:
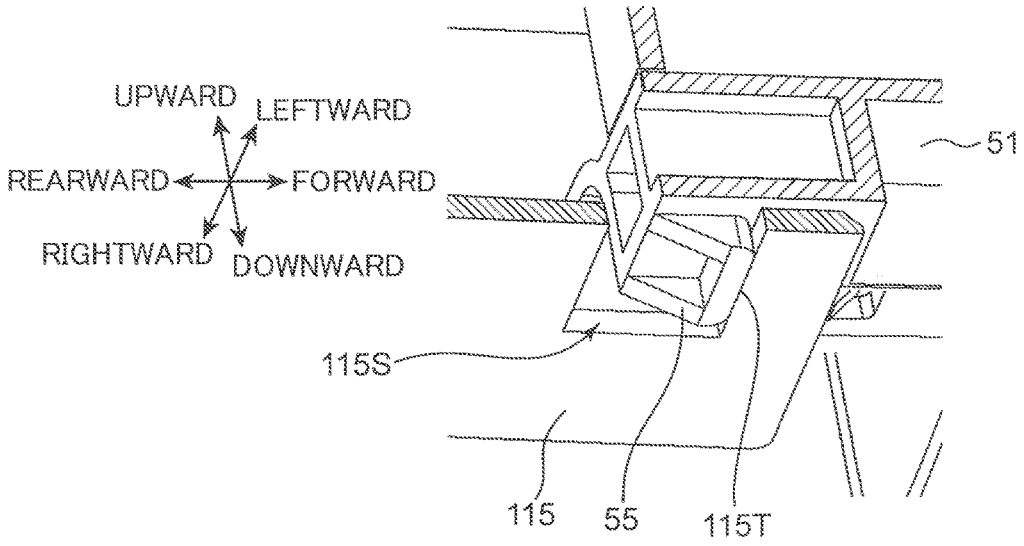
FIG. 8 is a cross-sectional perspective view obtained by enlarging a periphery of the container protrusion part of the toner container according to one embodiment of the present disclosure.

FIG. 3 is a perspective view of a toner container 51 and a container pressing unit 61 (pressing unit) according to the present embodiment. FIG. 4 is a perspective view of the container pressing unit 61 according to the present embodiment. FIG. 5 is a perspective view of the toner container 51 and a container cover 70 according to the present embodiment. FIG. 6 is a cross-sectional view of the toner container 51 and the container cover 70 according to the present embodiment. FIGS. 7 and 8 are cross-sectional perspective views obtained by enlarging a periphery of a container protrusion part 55 of the toner container 51 according to the present embodiment. The image forming apparatus 10 further includes a plurality of toner containers 51.

The plurality of toner containers 51 accommodates toner to be replenished to the plurality of developing devices 23. As shown in FIG. 3, the toner container 51 has a box shape extending long in a front-rear direction. A grip part 51A that can be gripped by a user is provided in a front end of the toner container 51. In FIG. 3, as shown in the front end thereof, the toner container 51 accommodates toner of magenta color (M). Note that the toner container 51 accommodating toner of another color is similar to the toner container 51 of FIG. 3 in structure. The plurality of toner containers 51 is arranged adjacent in a left-right direction in a container space S disposed above the intermediate transfer unit 14. In the present embodiment, four toner containers 51 are arranged in the container space S of FIG. 1. The toner containers 51, when installed at predetermined positions (replenishment positions) in the apparatus body 11, enables toner replenishment from the toner containers 51 to the developing devices 23.

In addition, the toner container 51 includes the container protrusion part 55 (FIGS. 6 and 7). The container protrusion part 55 is a protrusion part protruding downward from a front end of a bottom of the toner container 51. As shown in FIG. 7, the container protrusion part 55 has a trapezoidal shape in side view. A side surface on a backside of the container protrusion part 55 inclines upward along an installation direction (backward direction) of the toner container 51 in the apparatus body 11.

Figure 9A:
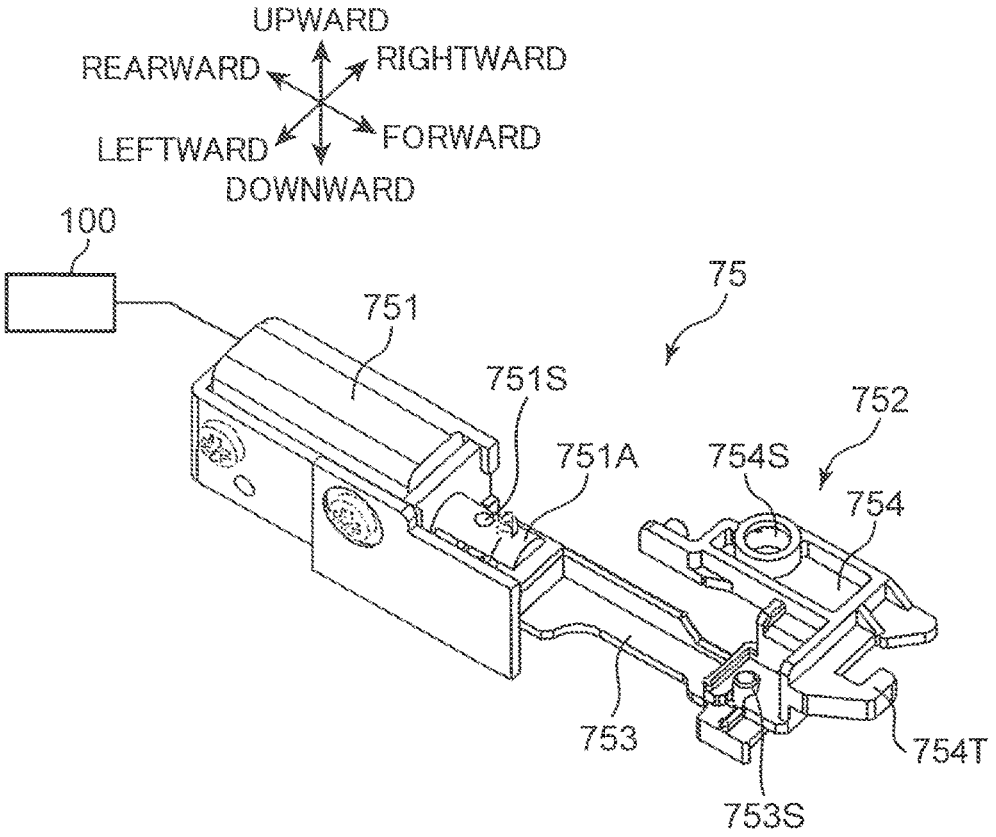
FIG. 9A is a perspective view of a cover opening mechanism according to one embodiment of the present disclosure, and is a perspective view in which a locking part is disposed at a locked position.

Furthermore, corresponding to toners of respective colors, the image forming apparatus 10 includes the container covers 70, cover opening mechanisms 75 (lock release mechanisms), the container pressing units 61 (pressing units), container locking parts 115 (latching parts), and interlocking mechanisms 7S. A plurality of these members is arranged corresponding to respective colors, and four members are arranged in the present embodiment. In addition, the image forming apparatus 10 includes a controller 100 (FIG. 9A).

The container covers 70 are exposed to outside of the apparatus body 11 by the body cover 11A being opened forward. In FIG. 2, the container covers 70 of respective colors are exposed in the front part of the apparatus body 11. Meanwhile, the container covers 70 are each switchable between an open state in which attachment and detachment of the toner container 51 to the apparatus body 11 are allowed, and a closed state in which detachment of the toner container 51 from the apparatus body 11 is prevented. In FIG. 2, the leftmost container cover 70 is in the open state, and other three container covers 70 are in the closed state.

With reference to FIG. 5, the container cover 70 includes a cover body 700, a cover fulcrum part 701, and a cover engagement part 702. The cover body 700 is a body part of the container cover 70, and has a shape covering a front of the toner container 51. The cover fulcrum part 701 is disposed in a lower end of the cover body 700. The cover fulcrum part 701 serves as a fulcrum for an opening and closing operation of the container cover 70, and extends in a left-right direction. The cover engagement part 702 is disposed in an upper end of the cover body 700, and is engageable with a lock engagement part 754T of a locking member 754 to be described later (refer to FIG. 10B).

The container pressing unit 61 (FIG. 3) has a function of pressing the toner container 51 toward the container cover 70 within the apparatus body 11. With reference to FIG. 4, the container pressing unit 61 includes a pressing unit body 610 and a pressing spring 613. The pressing unit body 610 is supported slidably in a front-rear direction within the apparatus body 11. The pressing unit body 610 includes a sliding part 611 and a pressing unit 612. The pressing unit body 610 is an L-shaped member in plan view. The sliding part 611 is disposed facing a back end of a left wall of the toner container 51. The sliding part 611 extends along a front-rear direction. The pressing unit 612 is connected to a back end of the sliding part 611, and is disposed facing a back wall of the toner container 51. One pair of upper and lower guided parts 611G is disposed in a front end of the sliding part 611. The guided parts 611G are fitted in a guide rail (not shown) included in the apparatus body 11, and guide the container pressing unit 61 along a front-rear direction.

The pressing spring 613 is disposed on a left surface of the sliding part 611. The pressing spring 613 includes a first engagement part 613A and a second engagement part 613B. The second engagement part 613B is latched by an engagement part (not shown) included in the apparatus body 11. The first engagement part 613A is latched by a back end of the sliding part 611 as shown in FIG. 4. When the toner container 51 is installed at the replenishment position in the apparatus body 11, the back end of the toner container 51 presses the pressing unit 612 backward, and the pressing spring 613 extends.

With reference to FIGS. 6 to 8, the container locking part 115 has a function of latching the toner container 51 against pressing force of the container pressing unit 61 at the replenishment position where toner can be replenished to the developing device 23 within the apparatus body 11. In the present embodiment, as shown in FIG. 6, the container locking part 115 is disposed below the toner container 51 within the apparatus body 11. Also, the container locking part 115 is disposed engageably with the container protrusion part 55 forward of the container pressing unit 61. The container locking part 115 is a plate-shaped part having a predetermined width in a left-right direction and extending long in a front-rear direction. The container locking part 115 includes a fixed end 115H and a free end 115J. The fixed end 115H is fixed to the apparatus body 11, whereas the free end 115J is disposed forward of the fixed end 115H and is elastically deformable vertically. The free end 115J has an opening 115S (FIGS. 7 and 8). The container protrusion part 55 can be inserted into the opening 115S from above. An inside surface on a front side of the container locking part 115 defining the opening 115S functions as a protrusion contact part 115T in contact with the container protrusion part 55 (FIG. 7).

Figure 9B:
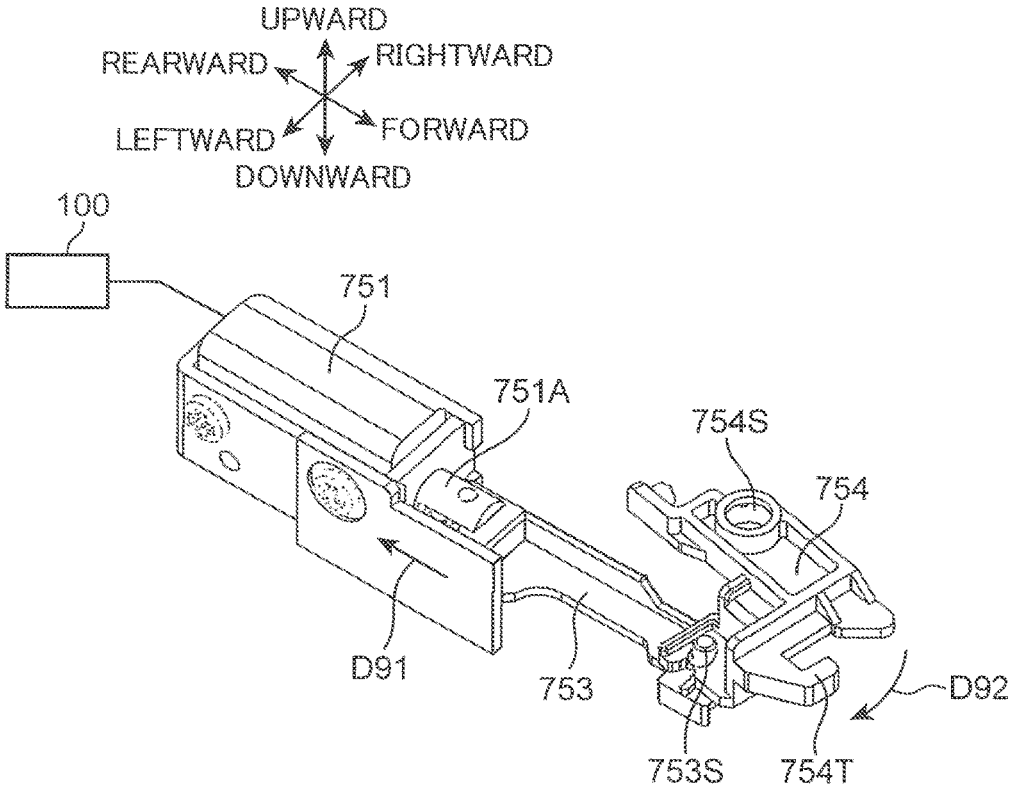
FIG. 9B is a perspective view of the cover opening mechanism according to one embodiment of the present disclosure, and is a perspective view in which the locking part is disposed at an unlocked position.
Figure 10A:
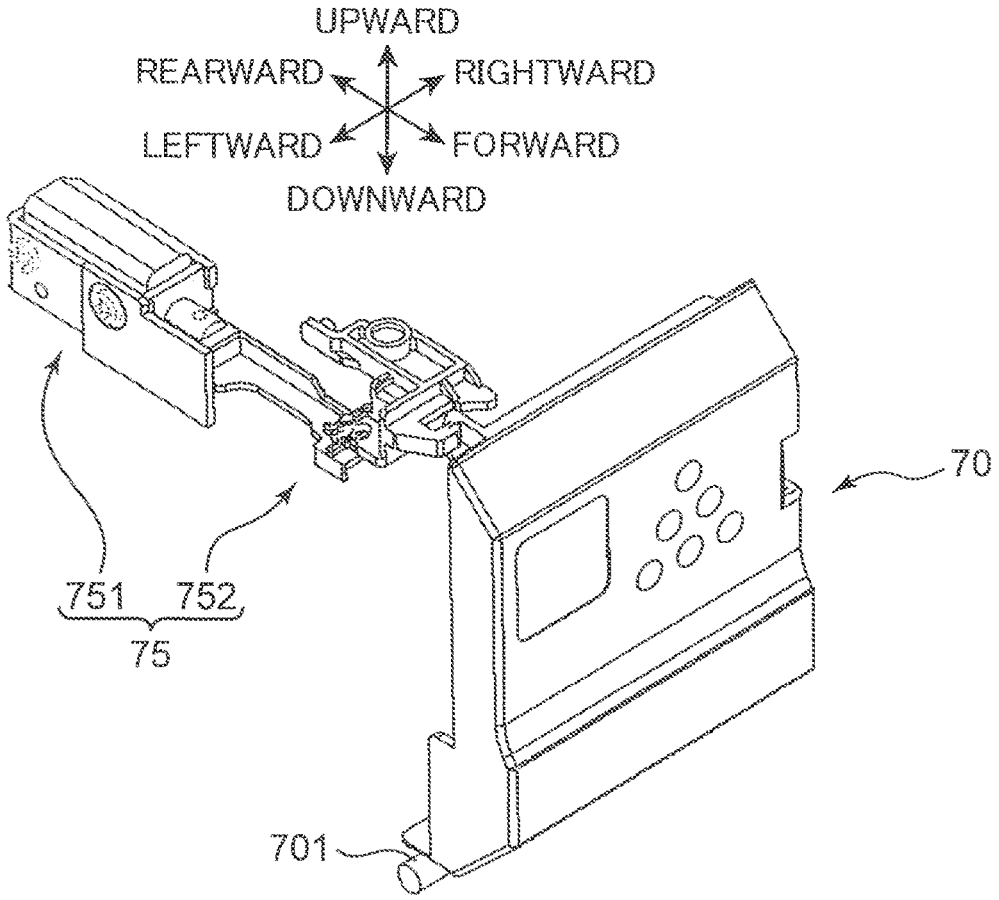
FIG. 10A is a perspective view of the cover opening mechanism and the container cover according to one embodiment of the present disclosure, and is a perspective view in which a lock engagement part is disposed at the locked position.
Figure 10B:
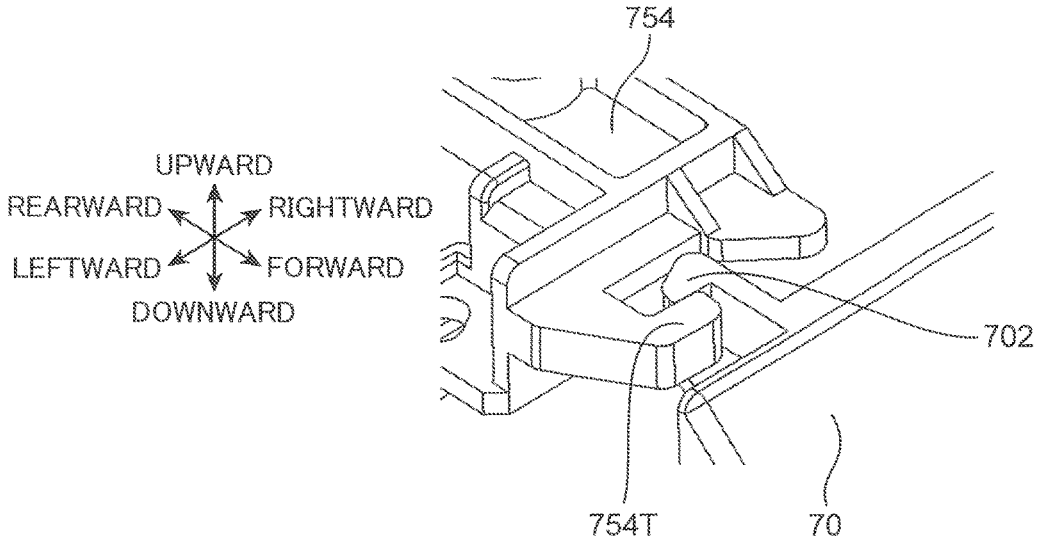
FIG. 10B is a perspective view obtained by enlarging a periphery of the lock engagement part of FIG. 10A.
Figure 11A:
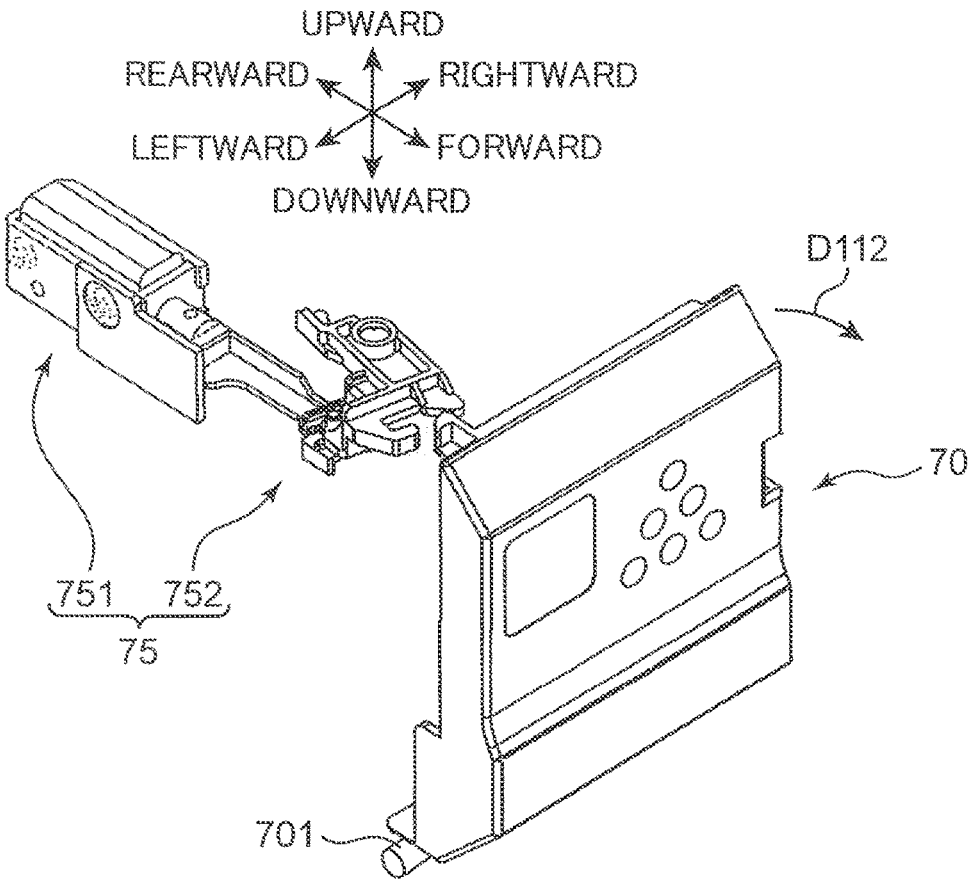
FIG. 11A is a perspective view of the cover opening mechanism and the container cover according to one embodiment of the present disclosure, and is a perspective view in which the locking part is disposed at the unlocked position.
Figure 11B:
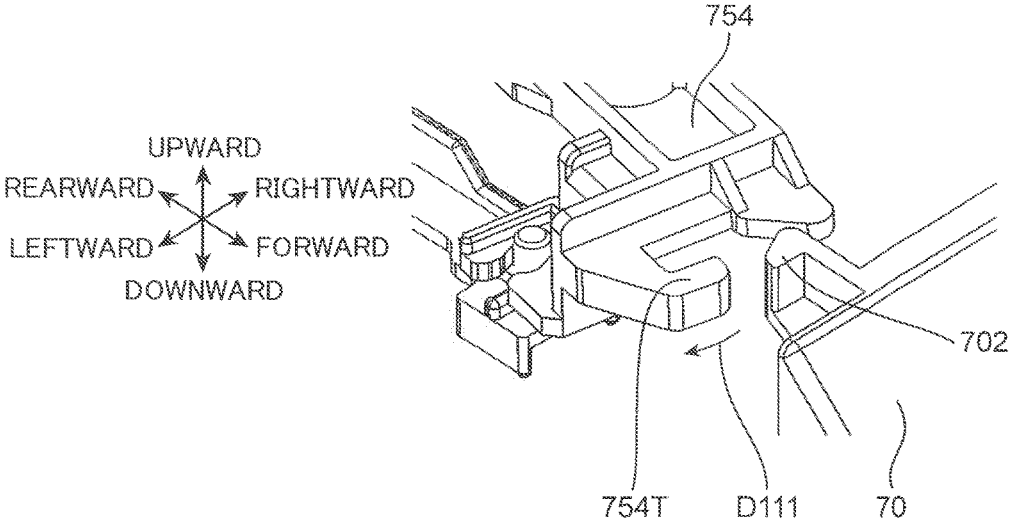
FIG. 11B is a perspective view obtained by enlarging a periphery of the locking part of FIG. 11A.

FIG. 9A is a perspective view of the cover opening mechanism 75 according to the present embodiment, and is a perspective view in which the lock engagement part 754T is disposed at a locked position. FIG. 9B is a perspective view of the cover opening mechanism 75 in which the lock engagement part 754T is disposed at an unlocked position. FIG. 10A is a perspective view of the cover opening mechanism 75 and the container cover 70 according to the present embodiment, and is a perspective view in which the lock engagement part 754T is disposed at the locked position. FIG. 10B is a perspective view obtained by enlarging a periphery of the lock engagement part 754T of FIG. 10A. FIG. 11A is a perspective view of the cover opening mechanism 75 and the container cover 70, and is a perspective view in which the lock engagement part 754T is disposed at the unlocked position. FIG. 11B is a perspective view obtained by enlarging a periphery of the lock engagement part 754T of FIG. 11A.

The cover opening mechanism 75 (lock release mechanism) is disposed facing the container cover 70 in the apparatus body 11 (FIG. 10A). The cover opening mechanism 75 includes a solenoid 751, a locking mechanism 752, and the controller 100.

The solenoid 751 includes a projectable/retractable output shaft 751S. A movement of the output shaft 751S in the solenoid 751 is controlled by the controller 100. A solenoid coupling part 751A is disposed at a front end of the output shaft 751S.

The locking mechanism 752 is coupled to the solenoid 751. The locking mechanism 752 has a function of locking the container cover 70 in a closed state, and a function of releasing the lock and makes the container cover 70 in an open state. The locking mechanism 752 includes a link member 753 and a locking member 754 (locking part).

The link member 753 couples the output shaft 751S of the solenoid 751 and the locking member 754. In more detail, the link member 753 transmits the movement of the output shaft 751S of the solenoid 751 to the locking member 754, and separates the locking member 754 from the cover engagement part 702. A back end of the link member 753 is coupled to the solenoid coupling part 751A of the output shaft 751S. In addition, a cylindrical link fulcrum part 753S is protruded in a front end of the link member 753.

The locking member 754 locks the container cover 70 in a closed state. The locking member 754 includes a lock fulcrum part 754S and the lock engagement part 754T. The lock fulcrum part 754S is a circular hole disposed in a right back end of the locking member 754. The lock fulcrum part 754S serves as a fulcrum for a pivot of the locking member 754. A stud (not shown) provided in the apparatus body 11 is inserted into the lock fulcrum part 754S. The lock engagement part 754T is disposed in a front end of the locking member 754. The lock engagement part 754T has a U shape with a right side opened so as to be engageable with the cover engagement part 702 of the container cover 70. As shown in FIG. 9A, the locking member 754 is pivotably coupled to the link fulcrum part 753S on a backside of the lock engagement part 754T.

When the output shaft 751S of the solenoid 751 is retracted by the controller 100 from a state shown in FIGS. 9A, 10A, and 10B, the link member 753 is pulled backward by the output shaft 751S (arrow D91 of FIG. 9B). As a result, the locking member 754 coupled to the link member 753 pivots as shown by an arrow D92 of FIG. 9B by using the lock fulcrum part 753S as a fulcrum. Then, the lock engagement part 754T is separated leftward from the cover engagement part 702 of the container cover 70 (arrow D111 of FIG. 11B), and the container cover 70 is opened forward by using the cover fulcrum part 701 as a fulcrum (arrow D112 of FIG. 11A). In this way, in the present embodiment, when the cover opening mechanism 75 releases engagement of the cover engagement part 702 and the lock engagement part 754T, the container cover 70 pivots forward about the cover fulcrum part 701, whereby the container cover 70 switches its state from the closed state to the open state. Note that an opening operation of the container cover 70 may be performed by weight of the container cover 70 itself (center of gravity), or a coil spring (not shown) may be disposed in the cover fulcrum part 701. The coil spring presses the container cover 70 into the open state.

Figure 12A:
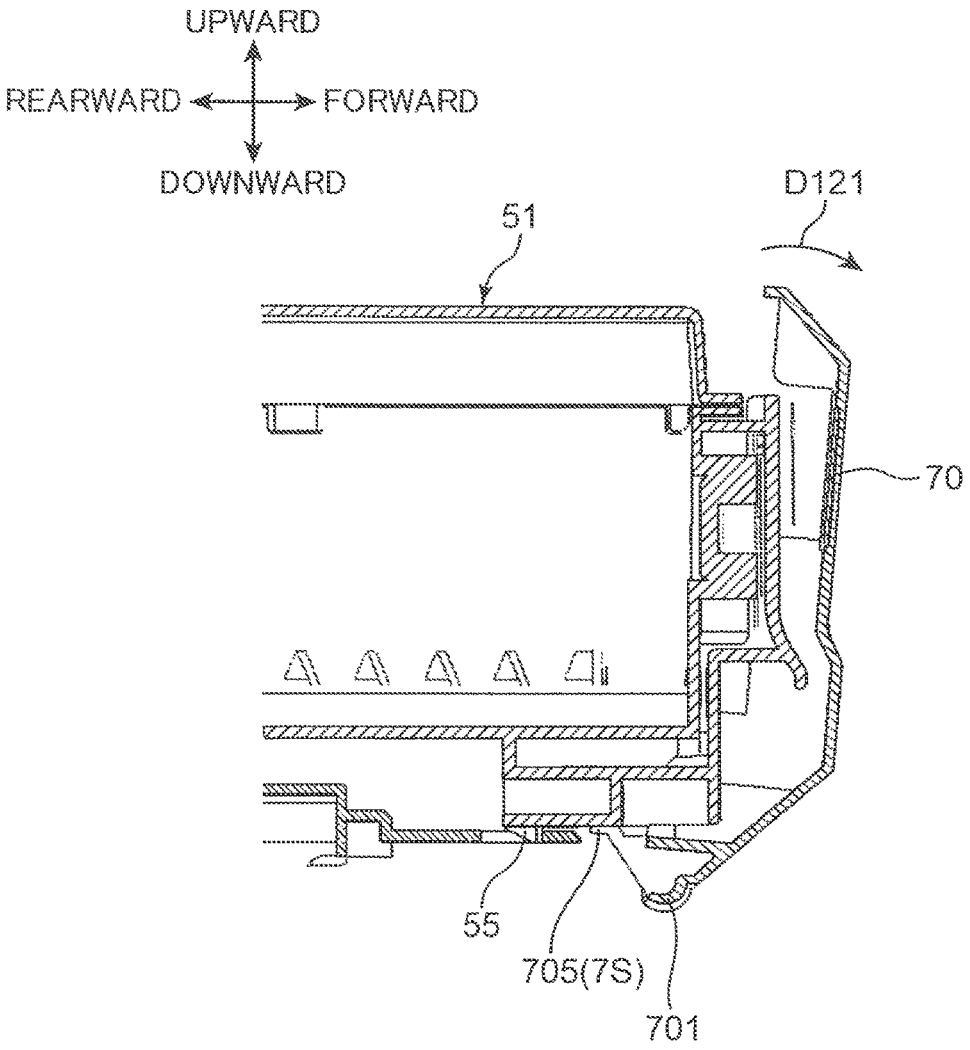
FIG. 12A is a cross-sectional view of the toner container and the container cover according to one embodiment of the present disclosure.
Figure 12B:
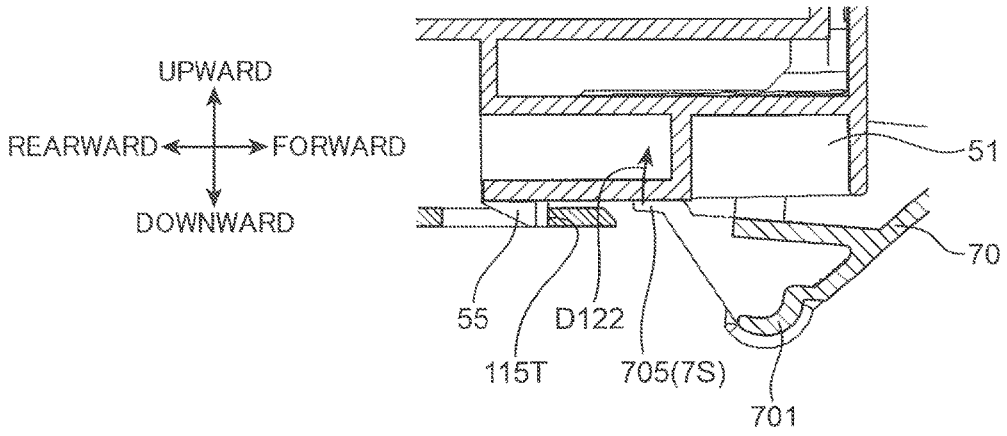
FIG. 12B is a cross-sectional view obtained by enlarging a periphery of a push up part of FIG. 12A.

FIG. 12A is a cross-sectional view of the toner container 51 and the container cover 70 according to the present embodiment. FIG. 12B is a cross-sectional view obtained by enlarging a periphery of a push up part 705 of FIG. 12A. The image forming apparatus 10 further includes the interlocking mechanism 7S. By releasing the latch of the container locking part 115 to the toner container 51 in conjunction with lock release of the container cover 70 by the cover opening mechanism 75, the interlocking mechanism 7S moves the toner container 51 from the replenishment position to the container cover 70 side by the pressing force of the container pressing unit 61. In the present embodiment, the interlocking mechanism 7S includes the push up part 705. With reference to FIG. 12A, the push up part 705 is disposed in the container cover 70. In more detail, the push up part 705 is disposed so as to extend backward from the cover fulcrum part 701. The push up part 705 is disposed facing a bottom of the container cover 70 exposed downward, forward of the container locking part 115.

The push up part 705 pushes up a portion of the toner container 51, which is in front of the container protrusion part 55, (arrow D122 of FIG. 12B) when the container cover 70 switches from the closed state to the open state (arrow D121 of FIG. 12A). As a result, the front portion of the toner container 51 rises upward, and engagement of the container protrusion part 55 and the container locking part 115 is released. Therefore, simultaneously with the container cover 70 being opened forward, or after the opening operation of the container cover 70, the toner container 51 is pushed out to the container cover 70 side by the container pressing unit 61. As a result, the front portion of the toner container 51 is exposed to (comes out into) the front part of the apparatus body 11, and the user can easily grip the toner container 51.

The image forming apparatus 10 further includes a plurality of toner sensors (not shown) facing respective toner containers 51 in the apparatus body 11. Each of the toner sensors detects that a toner quantity in the toner container 51 becomes less than a predetermined threshold. In other words, the toner sensor detects that the toner in the toner container 51 has become empty. The toner sensor includes a permeability sensor, and detects the toner charged into the toner container 51. When sufficient toner exists in the toner container 51, the toner sensor outputs a HIGH signal (+5 V). Meanwhile, when almost no toner exists in the toner container 51, the toner sensor outputs a LOW signal (0 V). Note that in other embodiments, the toner sensor may be a PI sensor (photosensor). In this case, an external wall of the toner container 51 is made of a transparent pipe member, and the PI sensor detects whether toner exists in the toner container 51. Also, in other embodiments, the toner sensor may be disposed in the developing device 23, or may be disposed in a portion of a toner conveyance path between the toner container 51 and the developing device 23.

The controller 100 detects that the predetermined toner container 51 out of the four (plurality of) toner containers 51 has become empty with reference to an output of the toner sensor at timing when the image forming apparatus 10 is not performing a print operation. As a result, the controller 100 retracts the output shaft 751S of the solenoid 751 of the cover opening mechanism 75 corresponding to the toner container 51 that has become empty, opens the container cover 70, and extrudes the toner container 51 as described above. This allows the user to replace the empty toner container 51 promptly and easily. In this case, a message to open the body cover 11A is preferably displayed in advance on a display panel of the image forming apparatus 10. After the cover sensor 11B detects that the body cover 11A is open, the controller 100 may open the predetermined container cover 70.

As described above, in the present embodiment, when the toner container 51 is installed in the apparatus body 11, the container locking part 115 latches the toner container 51 at the predetermined replenishment position. Therefore, the toner container 51 can stably replenish the toner to the developing device 23. Meanwhile, when the cover opening mechanism 75 releases the lock of the container cover 70, the interlocking mechanism 7S (push up part 705) releases the latch of the container locking part 115 to the toner container 51, thereby moving the toner container 51 to the container cover 70 side by the pressing force of the container pressing unit 61. Therefore, the user can easily check the toner container 51 to replace by opening of the container cover 70 and extrusion of the toner container 51. Also, since part of the toner container 51 is pushed out to the container cover 70 side, the user can easily grip the toner container 51.

Also, in the present embodiment, the push up part 705 pushes up the container protrusion part 55, thereby allowing the engagement of the container protrusion part 55 and the container locking part 115 to be easily released.

Also, in the present embodiment, pivoting about the cover fulcrum part 701 provided in a lower end of the container cover 70 allows the container cover 70 to be easily opened.

Also, in the present embodiment, the push up part 705 is disposed in the cover body 700 of the container cover 70, thereby allowing the container protrusion part 55 to be pushed up securely in conjunction with the opening operation of the container cover 70.

Also, in the present embodiment, the free end 115J of the container locking part 115 is elastically deformable. Therefore, when the toner container 51 is installed in the apparatus body 11, the container locking part 115 being elastically deformable downward will inhibit installation of the toner container 51 from being prevented. Also, when the push up part 705 pushes up the toner container 51, the container protrusion part 55 is detached upward from the opening 115S, thereby allowing the engagement of the container protrusion part 55 and the container locking part 115 to be easily released.

The image forming apparatus 10 according to the embodiments of the present disclosure has been described in detail above. Note that the present disclosure is not limited to these embodiments. The present disclosure can take, for example, the following variations.

(1) The above-described embodiments have described an aspect in which the toner containers 51 and the developing devices 23 are disposed for the toners of four colors. However, the present disclosure may be applied to a single-color (such as monochrome) image forming apparatus. That is, the number of developing devices, toner containers, and container cover units is not limited to numbers in the above-described embodiments.

Figure 13:
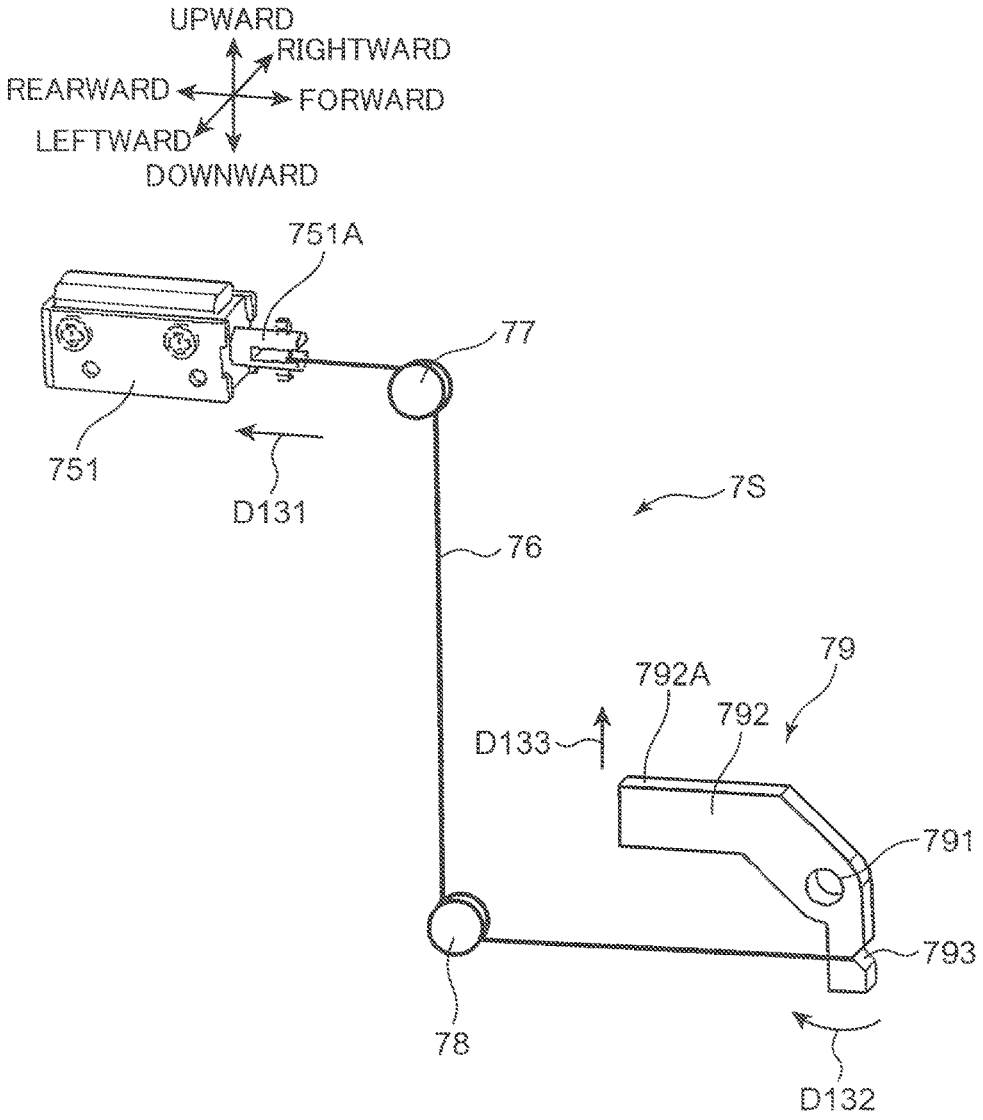
FIG. 13 is a perspective view of an interlocking mechanism according to a variation of the present disclosure.

(2) The above-described embodiments have described an aspect in which the push up part 705 of the interlocking mechanism 7S is disposed in the container cover 70. However, the interlocking mechanism 7S may be a member different from the container cover 70. FIG. 13 is a perspective view of the interlocking mechanism 7S according to another embodiment of the present disclosure.

In addition to the solenoid 751 similar to the solenoid 751 of the previous embodiment, the interlocking mechanism 7S includes a wire 76 (transmission part), a first pulley 77, a second pulley 78, and a push up member 79. The wire 76 is disposed so as to connect the solenoid coupling part 751A of the solenoid 751 to the push up member 79 within the apparatus body 11. The first pulley 77 and the second pulley 78 guide the wire 76 from the solenoid 751 toward the push up member 79. The push up member 79 is pivotably supported by the apparatus body 11 below the toner container 51. The push up member 79 includes a fulcrum part 791, a push up part 792, and a wire latching part 793. The fulcrum part 791 serves as a fulcrum for pivoting the push up member 79. The push up part 792 extends backward and upward from the fulcrum part 791, and can push up the toner container 51 (container protrusion part 55) from below. An end of the wire 76 is latched by the wire latching part 793.

In the present variation, when the controller 100 retracts the output shaft 751S of the solenoid 751 (arrow D131), the push up member 79 pivots with the fulcrum part 791 as a fulcrum (arrow D132). As a result, a contact part 792A of the push up part 792 pushes up the container protrusion part 55 from below (arrow D133), and releases the engagement of the container protrusion part 55 of the toner container 51 and the container locking part 115. Other configurations are similar to the configurations of the previous embodiment. According to the present variation, the container protrusion part 55 can be pushed up by using the solenoid 751 that generates driving force for opening the container cover 70. In this case, the wire 76 functions as a transmission part that transmits the movement of the output shaft 751S of the solenoid 751 to the push up part 792 and set the push up part 792 contact with and separate from the toner container 51 (container protrusion part 55).

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus comprising:

an apparatus body;

a body cover that allows opening and closing with respect to the apparatus body;

a plurality of photoreceptor drums, each of the photoreceptor drums being rotated about a predetermined axis and having a peripheral surface that allows formation of an electrostatic latent image and supports a toner image corresponding to the electrostatic latent image;

a plurality of developing devices, each of the developing devices being configured to supply the photoreceptor drum with toner to visualize the electrostatic latent image in the toner image;

a plurality of toner containers, each of the toner containers being configured to accommodate the toner to be replenished to the developing device;

a plurality of container covers to be exposed to outside of the apparatus body by the body cover being opened, each of the container covers being switchable between an open state in which attachment and detachment of the toner container with respect to the apparatus body are allowed, and a closed state in which detachment of the toner container from the apparatus body is prevented;

a plurality of lock release mechanisms, each of the lock release mechanisms including a locking part that locks the container cover in the closed state, the lock release mechanism being configured to release the lock of the container cover by the locking part and to make the container cover in the open state;

a plurality of pressing units, each of the pressing units being configured to press the toner container toward the container cover within the apparatus body;

a plurality of latching parts, each of the latching parts being configured to latch the toner container against pressing force of the pressing unit at a replenishment position where the toner is replenishable to the developing device within the apparatus body; and a plurality of interlocking mechanisms, each of the interlocking mechanisms being configured to move the toner container from the replenishment position to a side of the container cover by the pressing force of the pressing unit by releasing the latch of the latching part to the toner container in conjunction with the lock release of the container cover by the lock release mechanism.

2. The image forming apparatus according to claim 1, wherein the toner container includes a container protrusion part protruding downward from a bottom of the toner container, the latching part is disposed engageably with the container protrusion part forward of the pressing unit, and the interlocking mechanism includes a push up part configured to push up a portion of the toner container, which is in front of the container protrusion part, to release the engagement of the container protrusion part and the latching part.

3. The image forming apparatus according to claim 2, wherein the container cover includes:

a cover body having a shape to cover a front of the toner container;

a cover fulcrum part disposed in a lower end of the cover body; and a cover engagement part disposed in an upper end of the cover body, the cover engagement part being engageable with the locking part, and when the lock release mechanism releases the engagement of the cover engagement part and the locking part, the container cover pivots forward about the cover fulcrum part to switch the container cover from the closed state to the open state.

4. The image forming apparatus according to claim 3, wherein the push up part of the interlocking mechanism is disposed in the cover body, the push up part pushing up a portion of the toner container, which is in front of the container protrusion part, when the container cover switches from the closed state to the open state.

5. The image forming apparatus according to claim 3, wherein the lock release mechanism includes:

a solenoid including a projectable/retractable output shaft; and a link member configured to transmit a movement of the output shaft of the solenoid to the locking part, and to set the locking part contact with and separate from the cover engagement part, and the interlocking mechanism includes a transmission part that transmits the movement of the output shaft of the solenoid to the push up part and set the push up part contact with and separate from the toner container.

6. The image forming apparatus according to claim 1, wherein the latching part includes:

a fixed end fixed to the apparatus body;

a free end disposed forward of the fixed end, the free end being elastically deformable; and an opening disposed in the free end, the opening allowing insertion of the container protrusion part from above.

* * * * *